US005230527A

United States Patent [19]

Varan

[11] Patent Number: 5,230,527

[45] Date of Patent: Jul. 27, 1993

[54] SNOW SKI WITH IMPROVED TOE AND MID-LENGTH DESIGN

[76] Inventor: Cyrus O. Varan, 19 Siempre Verde, Albuquerque, N. Mex. 87123

[21] Appl. No.: 872,109

[22] Filed: Apr. 22, 1992

[51] Int. Cl.[5] ..... A63C 5/04

[52] U.S. Cl. ..... 280/609

[58] Field of Search ..... 280/601, 602, 608, 609, 280/610

[56] References Cited

U.S. PATENT DOCUMENTS

| | | | |
|---|---|---|---|
| 2,743,113 | 4/1956 | Griggs | 280/610 |
| 3,134,604 | 5/1964 | Aublinger | 280/608 |
| 3,687,469 | 8/1972 | Wada | 280/608 |
| 3,700,252 | 10/1972 | Schultes | 280/608 |
| 4,083,577 | 4/1978 | Ford | 280/609 |
| 4,175,766 | 11/1979 | Barwin | 280/608 |
| 4,377,297 | 3/1983 | Staufer | 280/609 |
| 4,826,201 | 5/1989 | Varan et al. | 280/609 |
| 4,906,016 | 3/1990 | Varan et al. | 280/609 |

FOREIGN PATENT DOCUMENTS

| | | |
|---|---|---|
| 55063 | 4/1935 | Norway . |
| 39116 | 11/1931 | Sweden . |

*Primary Examiner*—Richard M. Camby

*Attorney, Agent, or Firm*—Jacobson, Price, Holman & Stern

[57] ABSTRACT

A snow ski is provided including generally flat heel section, downwardly arched toe section, and an upwardly arched center section extending between and interconnecting the toe and heel sections. The opposite side marginal edges of the bottom of the ski define snow biting edges for biting into an underlying snow surface when the ski is angularly displaced about its longitudinal axis relative to snow surface and the snow biting edges extending along front portion of the elongated and longitudinally extending center section are bowed outwardly such that the position of the front bearing reaction is shifted backward when the skis are angularly displaced about the longitudinal axis to execute a turn.

3 Claims, 1 Drawing Sheet

SNOW SKI WITH IMPROVED TOE AND MID-LENGTH DESIGN

BACKGROUND OF THE INVENTION

1. Field of the Invention

This invention relates to a ski designed to increase the proficiency of elementary and intermediate level skiers and to enable these level skiers to execute turns in various snow surface conditions with greater control and confidence. The ski includes structural features which reduce the effective length thereof when edging during a turn and which further act to retard the speed of the ski.

2. Description of Related Art

Various different forms of modified snow ski edges heretofore have been designed for various reasons, including those modified ski edges disclosed in U.S. Pat. Nos. 2,743,113, 3,134,604, 3,687,469, 3,700,252, 4,083,577, 4,175,766, 4,826,201 and 4,906,016 as well as Norwegian Patent No. 55,063 and Swiss Patent No. 39,116. However, these previously known forms ski edges do not incorporate structure capable of performing the function of the ski edges of the instant.

SUMMARY OF THE INVENTION

The ski construction of the instant invention incorporates longitudinally arranged toe, center and heel sections with the bottom surface of the heel section being generally flat, the bottom surface of the center section being upwardly arched in its mid-portion, the bottom surface of the toe section being generally arched downwardly, the forward end of the toe section curving forwardly and upwardly into a terminal tip and with the toe, center and heel sections having different transverse widths normal to the longitudinal axis of the ski and the side surfaces of the center section of the ski including successive reversely curving sections. Each reversely curving side surface portion is such that the front portion of each side surface of the center section near the toe bulges outwardly and the rear portion of each side surface of the center section is concaved inwardly to reduce the ski width.

When a snow ski is angularly displaced about its longitudinal axis for executing a turn, the longitudinal side edge of the ski, which side edge is defined by the intersection of the bottom surface and corresponding side surface, to the inside of the turn bites into the snow surface to facilitate execution of the turn and to eliminate side slipping. In addition, the skier attempts to "pin" the toe section of the ski down harder upon the snow surface by shifting his or her weight forward as a result of a forward lean.

However, elementary and intermediate level skiers find it difficult to perform the toe pinning function required when using conventional skis and many of these elementary and intermediate level skiers experience excessive side slippage of their skis throughout length thereof when attempting to execute turns.

Being a good skier demands being able to shift weight to the toe area for a more effective toe pinning when negotiating a curve or turn. The ski toe characteristics comprise a significant character of the ski. The angular displacement of a ski about its longitudinal axis to execute a turn is commonly referred to as "edging".

When the ski of the instant invention is edged to execute a turn, the bearing point in the toe area shifts rearwardly due to a shift of the load on the toe area rearwardly from the bottom surface of the toe section to the crow of the bulged out side surface in the front portion of the center section of the ski.

This rearward shifting of the toe bearing point has the same effect as forward leaning of a skier to shift weight forward, which will increase the pressure in the toe area and facilitate a more effective toe pinning required for easier turning.

Thus, the principle difference between the ski of the instant invention and previously known skis is that in previously known skis the general position of the toe bearing point is the same when the skis are flat and when the skis are edged. In contrast, the ski of the instant invention provides means to automatically shift the bearing point rearward when the skis are edged without requiring the skier to lean forward.

The main object of this invention is to provide a snow ski which may be maneuvered through turns by elementary and intermediate level skiers with greater control and confidence.

Another object of this invention, in accordance with the immediately preceding object is to provide a modified ski which may be more readily maneuvered through turns in various different snow surface conditions.

Still another object of this invention is to provide an improved snow ski which will enable elementary and intermediate level skiers to more readily "pin" the toe section of the ski while executing turns.

A final object of this invention to be specifically enumerated herein is to provide an improved snow ski in accordance with the preceding objects and which will conform to conventional forms of manufacture, be of simple construction and easy to use so as to provide device that will be economically feasible, long-lasting and relatively trouble free in operation.

These together with other objects and advantages which will be subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
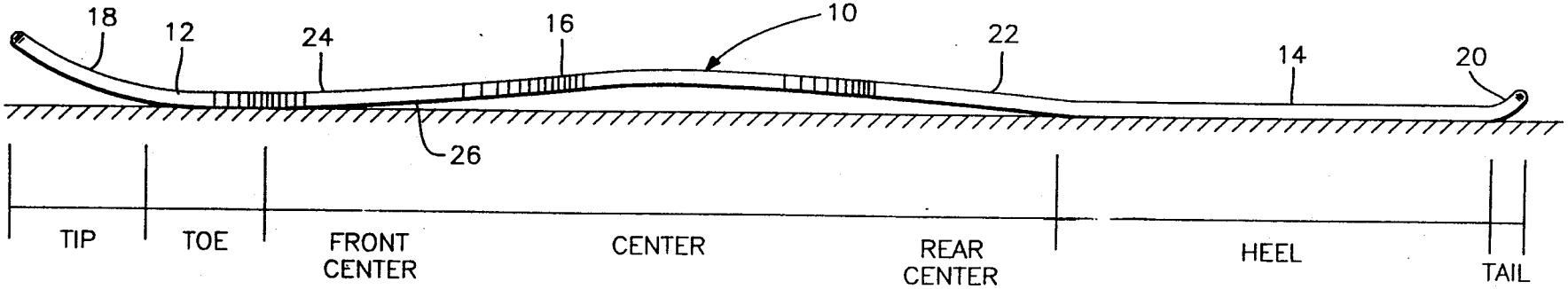
FIG. 1 is side elevational view of a typical snow ski constructed in accordance with the instant invention.
Figure 2:
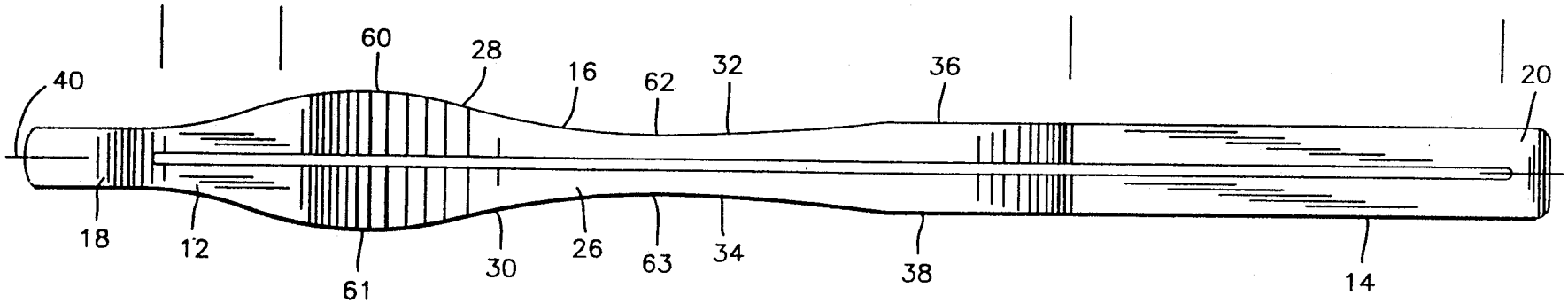
FIG. 2 is a bottom plan view of the snow ski illustrated in FIG. 1.

Referring now more specifically to the drawings the numeral 10 generally designates a snow ski constructed in accordance with the present invention and incorporating a forward toe section 12, a rear heel section 14 and an arched center section 16 formed integrally with and extending between and connecting the toe and heel sections 12 and 14. The toe section 12 terminates forwardly in a forwardly and upwardly curving tip 18 which is forwardly transversely tapered and the heel section 14 terminates rearwardly in an upwardly directed tail 20, although the tail 20 may be omitted.

The ski 10 incorporates an elongated body of which the sections 12, 14, 16, 18 and 20 comprise integral parts and the body 22 includes upper and lower surfaces 24 and 26 between which opposite side longitudinal surfaces 28 and 30 extend.

The lower surface 26 is generally arched downwardly throughout the toe section 12 and the heel section 14 is generally flat. Also, the lower surface 26 is arched upwardly throughout the mid-portion of the center section 16 and the lower surface 26 includes opposite side longitudinal margins 32 and 34.

The opposite side longitudinal surfaces 28 and 30 are bulged outwardly in the front portion of the center section 16 as at 60 and 61 and are concaved inwardly in the rear portion of the center section as at 62 and 63. When the ski is disposed upon a flat snow covered surface, the position of the front load bearing area of the lower surface 26 is generally in the longitudinal center of the toe section 12. When the ski 10 is edged for turning, the position of the front bearing area of the ski defined at the intersection of the lower surface 26 and the side surface 28 (for example) is shifted rearward from the longitudinal center of the toe section 12 to the longitudinal middle of the outward bulged area 60 of the side longitudinal surface 28. This specific feature of ski 10 which facilitates automatic rearward shifting of the front load bearing area when the ski is edged has three advantages.

First, the forward edge biting contact of the ski with the underlying snow surface automatically is increased when the skis are edged, which advantage facilitates a more effective and desirable "toe pinning" action when turning. Secondly, the spacing between the forward and rear ski contact areas with the supporting snow is reduced when the skis are edged. The reduction in spacing between the forward and rear ski contact areas is approximately equal to the rearward shifting of the position of the front bearing surface when the skis are edged (a length equal to the distance between the longitudinal center of toe 12 and the longitudinal center of the side bulged sections 60 and 61). This feature of ski 10, which facilitates the reduction of the contact length between the ski and the supporting snow surface when the ski is edged, facilitates easier turning of the ski as well since a shorter ski turns easier. Thirdly, the side wise outward bulging of the mid-portions 60 and 61 have a tendency to restrain and dampen the speed when the ski is in the flat, cruise position, which reduction in speed has appeal to beginners and intermediate level skiers. Fourthly, the toe section 12 of the instant ski has an average width less than the width of said ski between the inwardly concave sections 62 and 63. The previously known ski forms incorporate a toe section wider than the midsection. The narrower toe width of the instant ski will provide a lesser bearing surface in the toe area than that provided by known skis. A lesser bearing surface will result in a higher bearing pressure and improvement in toe pinning effect. As a result, the instant ski is slower than known skis and provides a firm control. The narrower the ski toe, the more slow the ski. Thus, different skis for different levels of proficiency is feasible with the instant ski depending on the toe width.

The intersections of the marginal portions 32 and 34 and the side surfaces 28 and 30 define edge means 36 and 38 for biting into an underlying snow surface when the body 22 is angularly displaced about its longitudinal center axis 40 relative to an underlying snow surface. These edge means 36 and 38 function to limit side slippage of the ski 10 when executing turns.

Further, inasmuch as the forward portions of the outwardly bulged sections 60 and 61 are forwardly convergent, the ski tends to plow slightly through the snow surface contacted by the under surface of the toe section 12 when the ski is flat upon the snow. This of course reduces the speed of the ski. Further, the toe 12 of the ski has an average width less than the width of the ski between the inwardly concave portions of the longitudinal side surfaces 28 and 30 of the body 20 as at 62 and 63 and the width of the ski between the inwardly concave sections 62 and 63 is less than the width of the heel section 14 of the ski.

The foregoing is considered as illustrative only of the principles of the invention. Further, since numerous modifications and changes will readily occur to those skilled in the art, it is not desired to limit the invention to the exact construction an operation shown and described, and accordingly, all suitable modifications and equivalents may be resorted to, falling within the scope of the invention.

What is claimed as new is as follows:

1. A snow ski designed to increase the proficiency of elementary and intermediate level skiers and to enable these level skiers to execute turns in various snow surface conditions with greater control and confidence, said ski including an elongated body defining a center longitudinal axis and including generally parallel upper and lower surfaces, said lower surface including an elongated and longitudinally extending forward and generally flat weight bearing toe section in contact with the snow surface, an elongated and longitudinally extending rear and generally flat heel weight bearing section in contact with the snow surface and an elongated and longitudinally extending center section, upwardly arched in its mid-portion, extending between and merging smoothly into and interconnecting said toe and heel sections, said toe section terminating forwardly in a forwardly and upwardly curving tip, said body upper and lower surfaces being interconnected by opposite side surfaces extending therebetween, said ski lower surface defining opposite side longitudinal marginal portions which are generally parallel at least in the heel section, and which are bowed outwardly at least on one side along a front portion of the elongated and longitudinally extending center section rearwardly of said weight bearing toe section and concaved inwardly, at least on said one side, along a rear portion of the elongated and longitudinally extending center section, each longitudinal margin including a lower surface edge defining means adjacent the corresponding side surface for biting into an underlying snow surface when said body is angularly displaced about its longitudinal center axis to raise the other longitudinal margin relative to said snow surface.

2. A snow ski including an elongated body having upper and lower surfaces interconnecting opposite side surfaces for effecting turns on various snow surfaces, said lower surface incorporating an upwardly arched, longitudinally extending, center section, a generally flat weight bearing heel section in contact with the snow surface extending rearwardly from the rear portion of said center section, a generally flat weight bearing toe section in contact with snow surface extending forwardly from the forward portion of said center section, and a forwardly and upwardly curving tip extending forward from said toe section, said side surfaces extending along said flat heel section being substantially parallel, said side surfaces being slightly inwardly bowed throughout a substantially longitudinally centered portion of said center section, said side surfaces being bulged outwardly throughout the forward portion of said center section rearward of said weight bearing toe section to a maximum width greater than the width of said heel section, and said side surfaces forward of said bulged out portions thereof being forwardly convergent throughout at least a major portion of said toe section with the average width of said toe section being less than the width of said heel section.

3. A snow ski including an elongated body having upper and lower surfaces interconnected by opposite side surfaces extending therebetween for effecting turns on various snow surfaces, said ski incorporating an upwardly arched, longitudinally extending center section, a generally flat weight bearing heel section in contact with the snow surface extending rearwardly from the rear portion of said center section, a generally flat weight bearing toe section in contact with the snow surface extending forwardly from the forward portion of said center section, and a forwardly and upwardly curving tip extending forward from said toe section, said side surfaces being generally parallel throughout said heel section, at least one of said side surfaces being slightly inwardly bowed throughout a substantially longitudinally centered portion of said center section, bulged outwardly throughout the forward portion of said center section rearward of said weight bearing toe section and being forwardly and inwardly inclined toward the longitudinal center axis of said ski throughout a substantial portion of said weight bearing toe section.

* * * * *